United States Patent [19]

Yasuda et al.

[11] Patent Number: 4,802,874

[45] Date of Patent: Feb. 7, 1989

[54] METHOD OF INSTALLING MOUNT ASSEMBLY IN CATHODE RAY TUBE

[75] Inventors: Koichi Yasuda, Yotsukaido; Yoshihiko Kimura, Chiba, both of Japan

[73] Assignee: Hitachi, Ltd., Tokyo, Japan

[21] Appl. No.: 21,396

[22] Filed: Mar. 4, 1987

[30] Foreign Application Priority Data

Mar. 19, 1986 [JP] Japan ..... 61-59157

[51] Int. Cl.[4] ..... H01J 9/40; H01J 9/42

[52] U.S. Cl. ..... 445/4; 445/45

[58] Field of Search ..... 445/45, 67, 4, 34

[56] References Cited

U.S. PATENT DOCUMENTS

| | | | |
|---|---|---|---|
| 3,962,764 | 6/1976 | Stewart et al. | 445/45 X |
| 3,962,765 | 6/1976 | Stachel et al. | 445/45 X |
| 4,148,117 | 4/1979 | Bracke et al. | 445/4 |
| 4,445,874 | 5/1984 | D'Augustine et al. | 445/67 X |

FOREIGN PATENT DOCUMENTS

| | | | |
|---|---|---|---|
| 109349 | 8/1980 | Japan | 445/4 |
| 41646 | 4/1981 | Japan | 445/64 |

*Primary Examiner*—Kenneth J. Ramsey

*Attorney, Agent, or Firm*—Antonelli, Terry & Wands

[57] ABSTRACT

There is disclosed a method of installing a mount assembly in a cathode ray tube wherein convergence characteristics are enhanced by properly setting levels of tube of a color cathode ray tube and of an electron gun. When a neck portion of the tube and a stem structure mounted with the electron gun are sealed to each other by heating, a distance between a standard level of the tube and that of the electron gun is measured. Comparison/arithmetic processing is effected both on the thus measured value and on a previously stored standard distance to seek a difference between the two values. The tube body or the electron gun is controlled by a moving operation so that the difference falls within an allowable value. After this, the sealing process is carried out.

4 Claims, 5 Drawing Sheets

METHOD OF INSTALLING MOUNT ASSEMBLY IN CATHODE RAY TUBE

BACKGROUND OF THE INVENTION

The present invention relates to a method of installing a mount assembly in a cathode ray tube. Such is the method that an electron gun structure (hereinafter simply referred to as an electron gun) is sealed to a tube of a cathode ray tube (hereinafter abbreviated to CRT) by measuring precisely a position of the electron gun with respect to a phosphor screen of the CRT so as to set it properly at a predetermined position.

Generally, in the process of manufacturing a color CRT, the phosphor screen, a graphite electrode and a shadow mask are provided in a glass bulb. Subsequently, a stem structure mounted with the electron gun is sealed to an opening end of a glass bulb neck portion. In this case, three streaks of electron beams which contribute to generation of color-signals of red, green and blue are brought to focus upon a preset position on the phosphor screen of the glass bulb. The following constituent elements are requisite to enhancement of convergence characteristics of the color CRT.

Namely, it is required that a level difference (hereinafter referred to as a sealing length) between a standard level (for instance, a level of a reference line of the glass bulb which will be mentioned later) of the glass bulb of the CRT and the standard level (for example, a level of a third grid of the electron gun which will be stated later) of the electron gun has a previously prescribed length.

Precisely speaking, the level difference between the standard level of the glass bulb and the standard level of the electron gun involves a length of interval between the above-described two standard levels when a tube-axis of the glass bulb and an axis of ordinate of the electron gun are arranged to be in the same direction.

A sealing apparatus shown in FIG. 1 has heretofore been employed in such a installing method that the electron gun is so sealed to the glass bulb of the color CRT of this type as to be joined to each other. In the FIG. 1, the reference numeral 1 stands for the glass bulb, 2 represents a bulb holder, 3 designates a pannel holder, 4 denotes a saddle, 9 represents a mount pin, 10 stands for the electron gun, and 11 designates the stem structure. The bulb holder 2 is mounted with the glass bulb 1 which is fixedly retained by the saddle 4 and the pannel holder 3. In a state wherein the electron gun 10 is retained by the stem structure 11, this stem structure 11 is inserted in the mount pin 9; and the mount pin 9 whereby the electron gun 10 and the stem structure 11 are retained is raised by driving means (not illustrated), thereby inserting the electron gun 10 into a neck portion **1*b* of the bulb 1. Thereafter, the level of the mount pin 9 continues to be adjusted until a dimension measured from a reference line R/L (an imaginary line depicted by a one-dot chain line in FIG. 1) of the glass bulb 1, which line is in general determined by an installing position of the saddle 4, to the standard level of the mount pin 9 is to a predetermined valve. When the predetermined dimension is obtained, the stem structure 11 and the bulb neck portion 1*b*** are subjected to heat-processing, thus sealing the two members.

According to the above-described installing method, fluctuations occur in dimension between the standard level of the electron gun 10 and the standard level (in this case, the reference line R/L) of the glass bulb 1 due to the fact that the dimension at the sealing time which extends from the electron gun 10 to the stem structure 11 fluctuates, and that the stem structure 11 is slackened from the mount pin 9 by mechanical vibrations or other factors, which results in deterioration of the convergence characteristics. It is therefore difficult to procure the CRT invested with desired properties.

Excepting the reference line R/L, for instance, an apical face (or an apex) of an outer surface of the panel **1*a*, or the apical face (or the apex) of an inner surface of the same panel 1*a*** serves as the standard level of the aforementioned bulb.

The prior art relative to the sealing process of the glass bulb and the electron gun in the CRT is disclosed in the specification of, for example, U.S. Pat. No. 3,962,764.

SUMMARY OF THE INVENTION

The present invention is associated with such a method of installing a mount assembly in a cathode ray tube that excellent convergence characteristics and images of good quality are obtained.

Accordingly, it is a primary object of the present invention to provide a method of installing a mount assembly in a cathode ray tube wherein: when a glass bulb neck portion and a stem structure undergo heat-processing so as to be sealed to each other, there is measured a distance (as explained earlier, this distance means a distance between two standard levels, where a tube-axis of a glass bulb and an axis of ordinates of an electron gun are arranged to be in the same direction) between the standard level of the glass bulb and the standard level of the electron gun; and a comparison-/arithmetic process is effected with respect to the thus obtained measurement distance and a previously stored standard distance. At least either the glass bulb or the stem structure (mounted with the electron gun) is controlled such as to be moved in the direction of the above-mentioned axis of ordinates so that a difference between the measurement distance and the standard distance falls within allowable values. In time of coming within a range of the allowable values, the sealing process is performed.

DESCRIPTION OF THE PREFERRED EMBODIMENT

Figure 1:
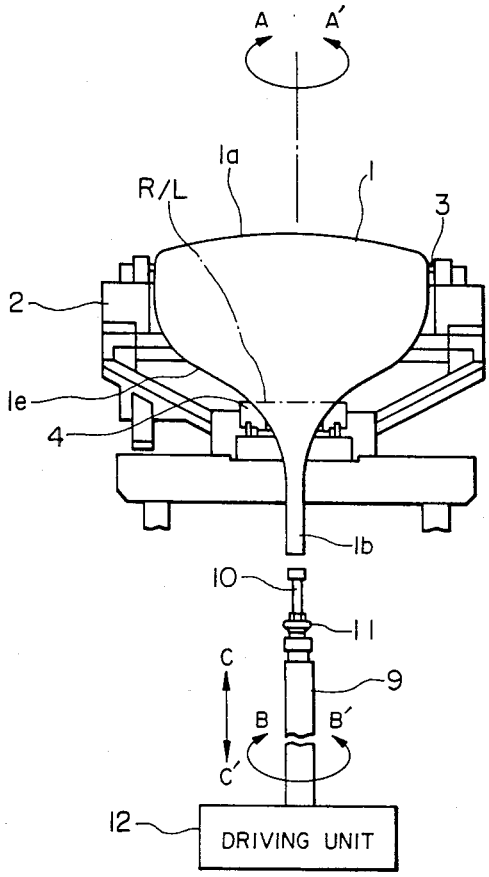
FIG. 1 PRIOR ART
FIG. 1 is a side view of an installing apparatus intended to explain a conventional method of installing a mount assembly in a cathode ray tube.
Figure 2:
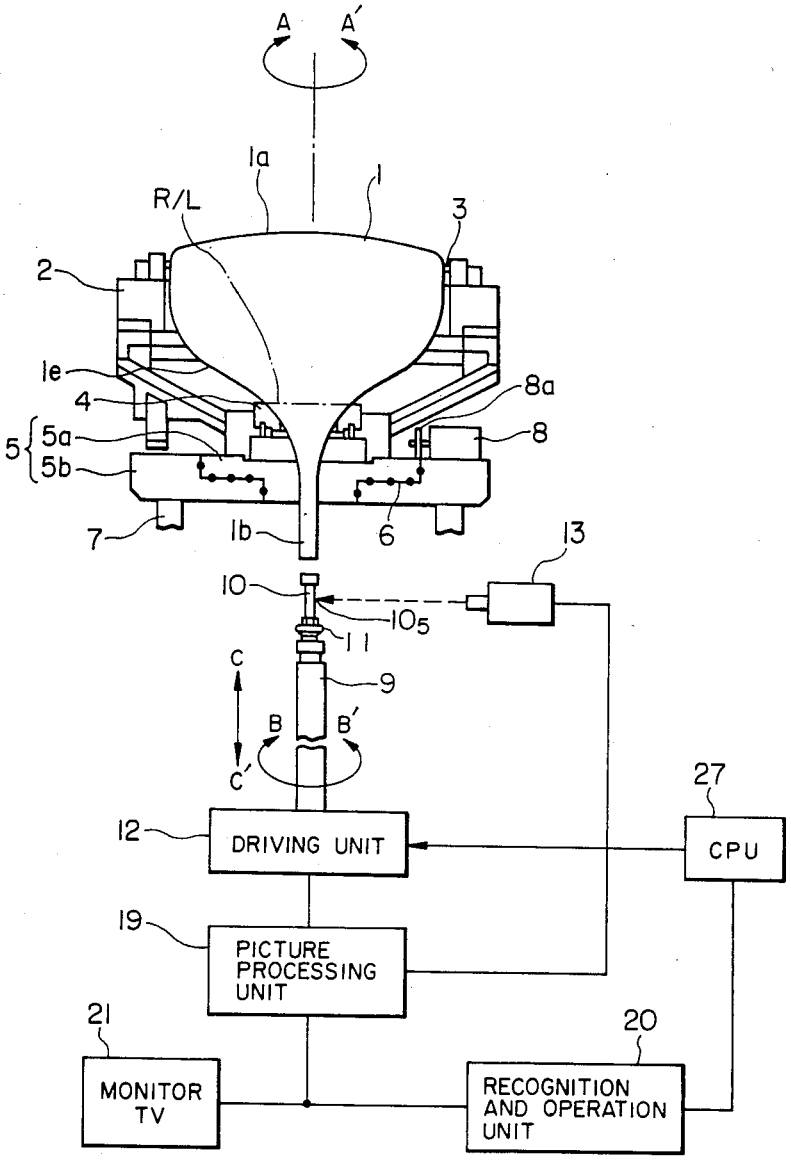
FIG. 2 is a block diagram of the installing apparatus intended to explain one embodiment of a method of installing a mount assembly in a cathode ray tube according to the present invention.
Figure 3:
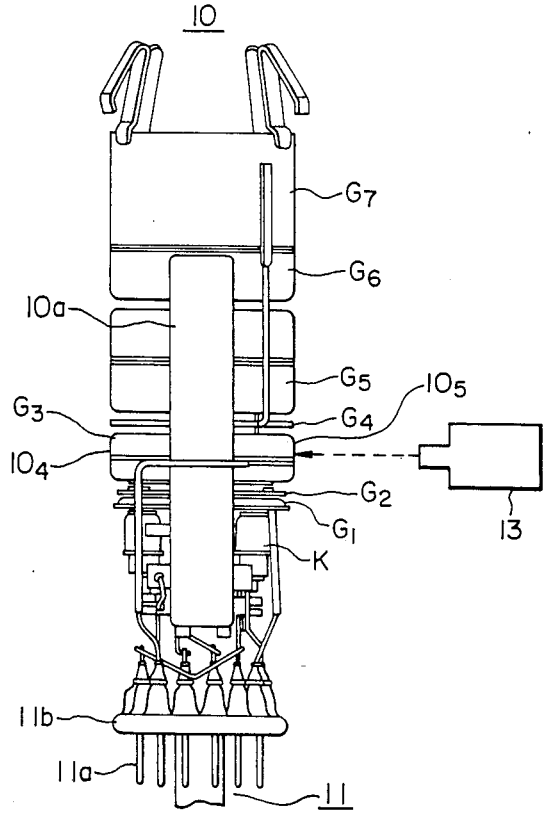
FIG. 3 is a view showing one example of a constitution of an electron gun intended to explain the present invention.
Figure 4A:
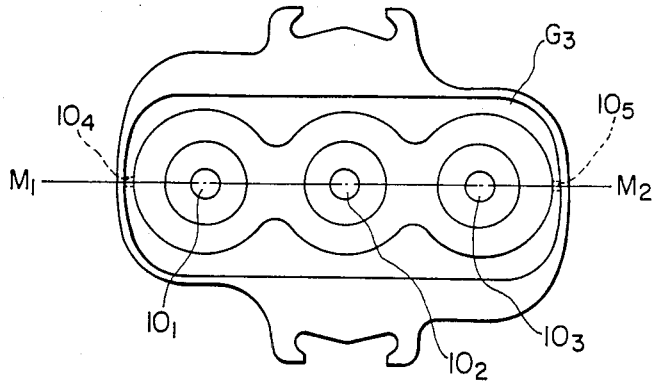
FIG. 4(*a*) is a plan view showing the principal portion of the electron gun employed for one embodiment of the present invention, and FIG. 4(*b*) is a side view thereof.
Figure 4B:
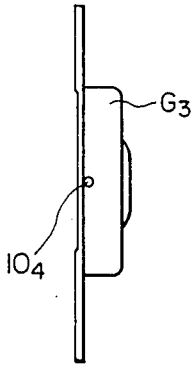

FIG. 2 is a block diagram of a cathode ray tube and its installing apparatus which are intended to explain one embodiment of a method of installing a mount assembly in a cathode ray tube according to the present invention. Reference numeral 1 stands for a glass bulb internally provided with a phosphor screen, a graphite electrode and a shadow mask, 2 designates a bulb holder for holding the glass bulb. The bulb holder 2 is integral with a panel holder 3 which retains the outer peripheral surface of a panel 1*a* of the glass bulb 1. The numeral 4 stands for a saddle for retaining a funnel-like member 1*e* of the glass bulb 1, 5 represents a holder base for supporting the bulb holder 2 and the saddle 4. This holder base 5 having a slide member 6 provided therein is composed by a first holder base 5*a* and a second holder base 5*b* which are rotatable in the directions shown by arrowheads A, A'. The numeral 7 denotes a support for fixing the second holder base 5*b*. 8 represents a driving unit consisting of, for example, a pulse motor (not illustrated) or the like, this driving unit being fixedly disposed on the second holder base 5*b*. A gear 8*a* of the driving unit 8 engages with the first holder base 5*a*; and the first holder base 5*a* is rotated at a given pitch in the directions shown by the arrowheads A, A' in response to pulse signals which are adequately inputted from a Central Processing Unit (CPU) 27 to the driving unit 8. On the support 7 is fixedly disposed the second holder base 5*b* effectively integral with the first holder 5*a* mounted with the glass bulb 1 and bulb holder 2 through the slide member 6; and these components inclusive of the saddle 4 and the like are as a unit rotated in the directions of the arrowheads A, A' by actuation of the driving unit 8. The adjustment is made so that the phosphor screen provided on the inner surface of the glass bulb is properly irradiated with three streaks of electron beams which contribute to luminescence of three colors of red, green and blue. The numeral 9 represents the mount pin mounted with the stem structure 11 on which the electron gun 10 is loaded, this mount pin 9 being so disposed as to be coaxial with the glass bulb 1. Numeral 12 stands for the driving unit having the pulse motor for rotating the mount pin 9 in the directions indicated by the arrowheads B, B' and for moving vertically the same pin in the directions of the arrowheads C, C'. As illustrated in FIG. 3, the electron gun employed in this embodiment is constructed such that on the stem glass 11*b* into which stem pins 11*a* are implanted are, with predetermined dimensions, consecutively superposed a cathode K, a first grid $G_1$, a second grid $G_2$, a third grid $G_3$, a fourth grid $G_4$, a fifth grid $G_5$, a sixth grid $G_6$ and seventh grid $G_7$ which are fixedly supported by a multi form glass 10*a*. The third grid $G_3$ includes three holes $10_1$, $10_2$, $10_3$ through which the electron beams pass, these holes being, as illustrated in FIGS. 4(*a*), 4(*b*), aligned in an In-line direction; and round or angular reference holes $10_4$, $10_5$ which prescribe a horizontal axis of $M_1$–$M_2$ are also formed in the third grid $G_3$. In FIG. 2, an ITV camera 13 is so disposed as to be coaxial with the mount pin 9 and parallel to the lengthwise direction thereof. This ITV camera is provided so that it can image the reference hole $10_4$ or the hole $10_5$ formed in the third grid $G_3$ shown in FIGS. 4(*a*), 4(*b*).

A picture processing unit 19 effects digital image processing on the reference hole $10_4$ or the hole $10_5$ which is imaged by the ITV camera 13, thereby obtaining light-intensity image signals of the reference hole. A rccognition-and-operation unit 20 is invested with storage and arithmetic functions of the CPU 27 by virtue of the light-intensity image signals thereby to seek a configuration of an outline of the reference hole and further the position of the center of the image in terms of coordinate.

Incidentally, the numeral 21 stands for a monitor TV.

Figures 5A, 5B:
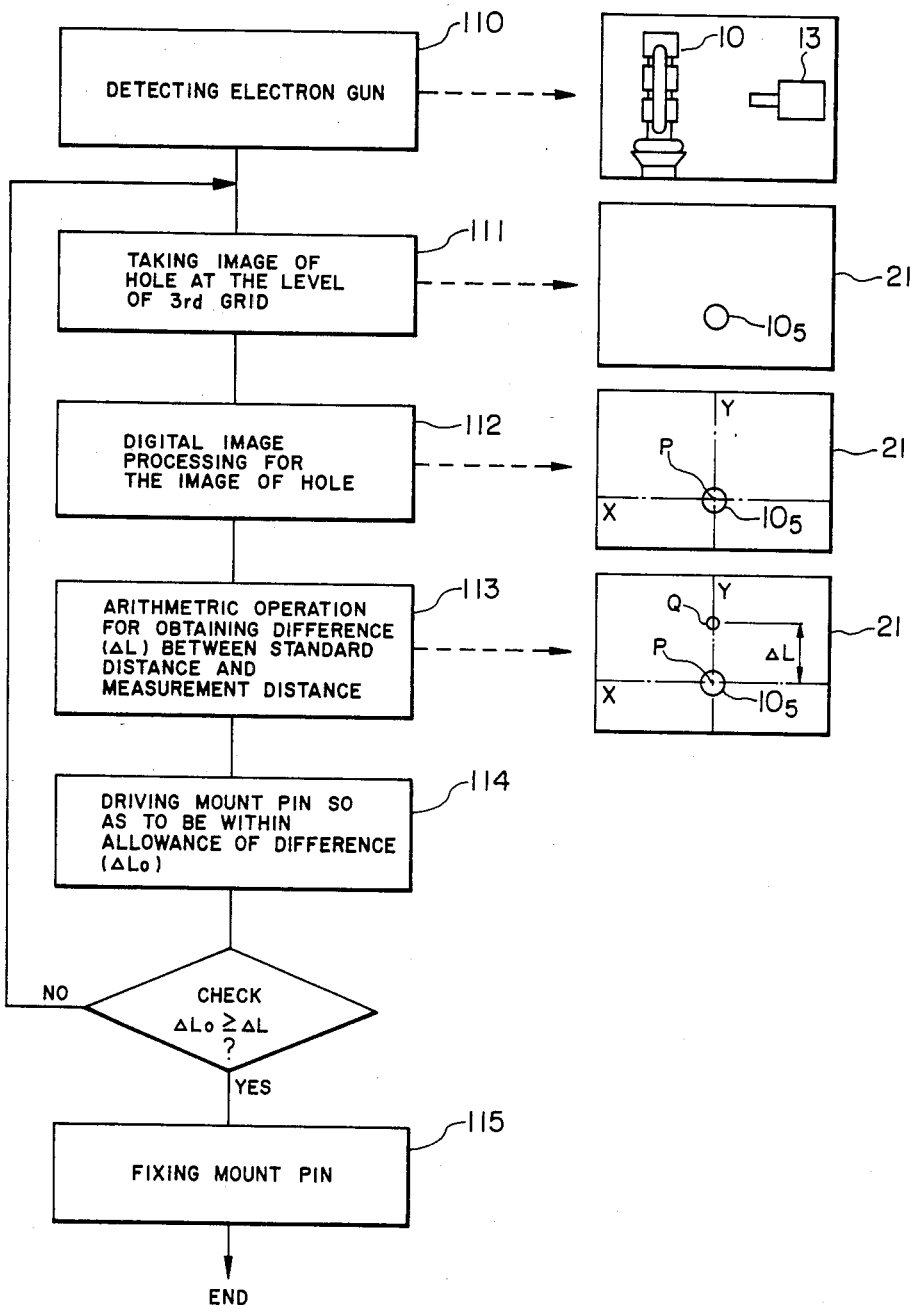
FIG. 5(*a*) is a flowchart showing one example of controlling operations relative to the present invention which include a step of detecting a standard level of the electron gun, a step of controlling on the basis of the results of detection so that a desired level-interrelation between a tube of the CRT and the electron gun is established, and a step of fixing a mount pin for holding the electron gun and a stem structure in preparation for the sealing process, and FIG. 5(*b*) is a diagram showing the principal operations in the flow of controlling operations which is shown in FIG. 5(*a*)

Further, the operations of the thus constructed apparatus for installing the mount assembly in the CRT will be described with reference to FIGS. 5(*a*), 5(*b*). FIG. 5(*a*) is a flowchart, and FIG. 5(*b*) is a diagram of monitor pictures each showing a situation of the individual processes thereof.

In FIGS. 5(*a*), 5(*b*), after detecting the existence of the electron gun 10 by the photographing through the first ITV camera 13 in a step 110, the ITV camera takes a photograph of an enlarged image of the reference hole $10_4$ or the hole $10_5$ of, for example, the third grid $G_3$ in a step 111 when the electron gun 10 is present (the enlarged image of the reference hole $10_5$ is shown in FIGS. 4(*a*), 4(*b*).

In a step 112, the picture processing unit 19 effects the digital image processing on the reference hole $10_4$ or the hole $10_5$ which is enlarged on the display screen, whereby the light-intensity image signals of the foregoing reference hole are obtained. Thereafter, as described above, the recognition operation unit 20 together with the CPU 27 seeks the configuration of the outline of the reference hole with the help of the light-intensity image signals and transforms the center position P of the reference hole into a position on the screen in terms of coordinate.

In a step 113, the recognition operation unit 20 and the CPU 27 seek the measurement distance between the coordinate P of the center of the reference hole 105 and the standard level Q of the tube 10 in terms of coordinate, i.e. a level coordinate in the longitudinal direction of the R/L line which has been previously stored in the CPU 27. The specific details of the image processing need not be described here as they are conventional and already known to persons skilled in the processing field, albeit not in the manner in which they have been utilized in the invention for the assembly of a cathode ray tube.

Following this step, there is obtained a difference (correction value Δ L) between the distance (the standard distance between the R/L line and the center of the reference hole in this embodiment), which is stored in the CPU 27 beforehand, extending from the standard level of the tube to that of the electron gun and the above-described measurement distance. The thus obtained difference Δ L is stored in the CPU 27.

In a step 114, an alignment pulse motor is driven in response to instruction signals transmitted from the CPU 27, and the mount pin 9 is so controlled as to be moved in the directions of the arrowheads C, C' so that the difference Δ L is diminished. If the above-mentioned difference does not come within a preset allowance of difference (Δ Lo), for example, +0.5 mm, the program returns to the aforementioned step 111 where the measuring and arithmetic operations resume.

Figure 6:
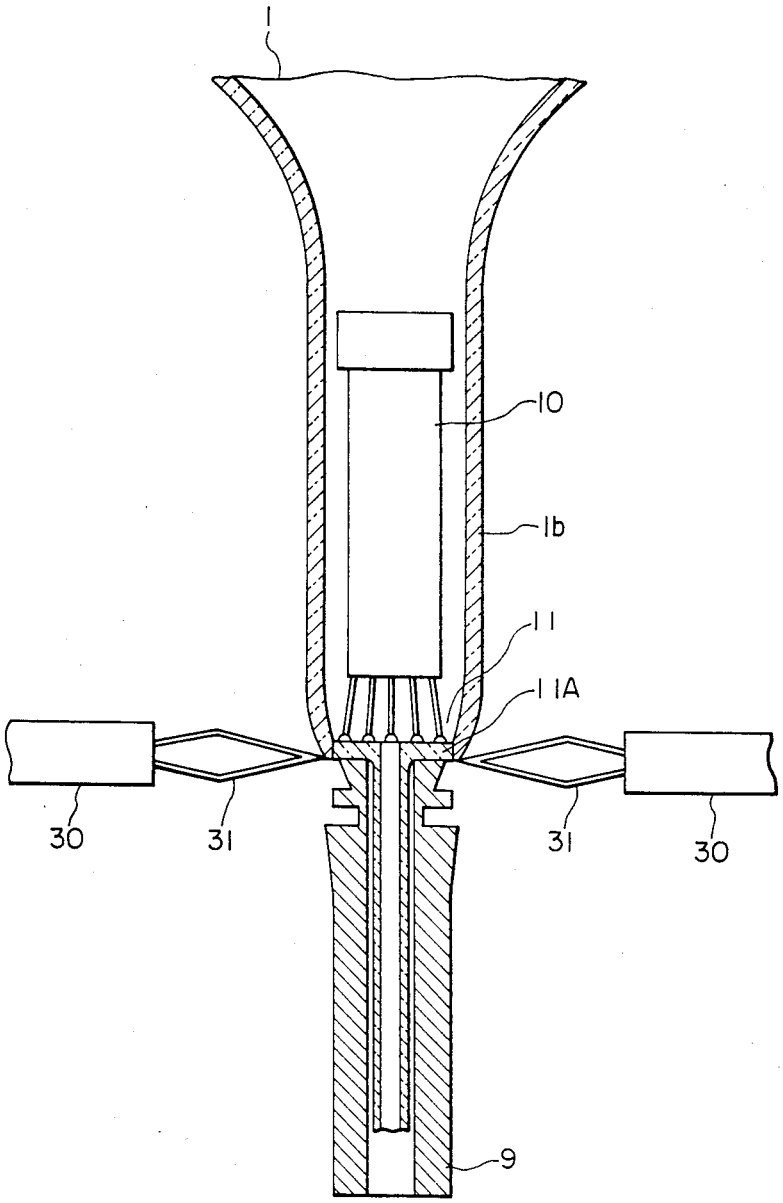
FIG. 6 is a view showing a sealing method to explain one embodiment of the present invention.

Whereas if the difference falls within the allowance of difference, the mount pin 9 ceases to be driven in a step 115, thereby fixing its operation. As illustrated in FIG. 6, the neck portion 1*b* of the glass bulb 1 and the stem glass 11*a* of the stem structure 11 mounted with the electron gub 10 are heat-processed by flames 31 generated by a gas burner 30 of the sealing apparatus, thus welding the two members to such an extent that they are sealed to each other.

According to this method, it is feasible to obtain the distance with high accuracy between the reference line R/L of the glass bulb 1 and the reference hole $10_4$ or the hole $10_5$ of the third grid $G_3$, and the thus obtained distance resultingly approximates the predetermined value, in which state the sealing operation is carried out. Hence, occurrence of mis-convergence can substantially be avoided, and adjusting operations by a deflecting yoke can be facilitated. In addition, the time required for the adjustment can be shortened, thereby improving the productivity.

According to this method, the distance between the standard level Q from the reference line R/L and the coordinate P of the reference hole $10_4$ or the hole $10_5$ is obtained by moving the mount pin 9 in the vertical direction alone (shown by the arrowheads C, C'), inaccuracies caused by torsion produced in the direction of rotation of the glass bulb 1 and the electron gun 10 or by inclined angles is unlikely to be created. As a result, it is possible to achieve an easy and highly accurate sealing process.

In the above-described embodiment, the holder base 5 for retaining the glass bulb 1 is fixed, and mount pin 9 on which the electron gun 10 is loaded is driven in the vertical direction (pointed by the arrowheads C, C') in order to obtain the sealing length. The present invention is not, however, confined to this method. For instance, even if the mount pin 9 is fixed and the holder base 5 is driven in the vertical direction, the same effects mentioned above will be yielded. The embodiment in which the standard level of the glass bulb 1 serves as the reference line R/L is so far described. As explained earlier, however, if there is prescribed a level capable of clearly determining the level-interrelation between the glass bulb and the electron gun which serves to improve the convergence characteristics, such level may be defined as the standard level of the tube other than the reference level R/L.

As for the electron gun, the level of the third grid of the electron gun is defined as the standard level thereof in this embodiment. However, if there is prescribed a level of the electron gun which determines the fundamental level-interrelation between the glass bulb and the electron gun, this level, other than grid $G_3$, may serve as the standard level of the electron gun.

In the aforementioned embodiment, a beam configuration in the color CRT is of the IN-line type. The present invention is not, however, limited to this type. For instance, a delta type is also applicable.

As can be seen from the above description, the present invention yields the following excellent effects. Inasmuch as the sealing length ranging from the standard level of the glass bulb to that of the electron gun is set in a highly accurate manner and the sealing process is then effected, it is feasible to obtain high productivity of the cathode ray tube which is invested with good dynamic convergence characteristics and forms images of fine quality.

What is claimed is:

1. In a method of sealing a stem structure mounted with an electron gun to the inside of an opening end of a neck portion of a tube of a color cathode ray tube which includes at least a phosphor screen and a shadow mask, the steps of installing a mount assembly in the cathode ray tube, comprising:

detecting a distance between a standard level of said tube and a standard level of said electron gun in a case where a tube-axis of said tube body and an axis of ordinates of said electron gun are in the same direction;

seeking a correction value by making a comparison between the detected distance and a preset standard distance between the standard level of said tube and the standard level of said electron gun;

decreasing the correction value by moving at least one of said tube and said electron gun in the direction of the axis of ordinates; and sealing said opening end of said neck portion of said tube enclosing said electron gun after the correction value has fallen within a predetermined allowable value.

2. In a method as set forth in claim 1, wherein said sealing is performed after repeating the steps of detecting, seeking and decreasing a plurality of times.

3. In a method as set forth in claim 1, wherein a level of a grid unit of said electron gun is defined as the standard level thereof, and a reference line determined with respect to an installing position of a saddle of said tube is defined as the standard level thereof.

4. In a method as set forth in claim 1, wherein said detecting step consists of a first substep of imaging with an ITV camera a reference hole which serves as the standard level of said electron gun in the vicinity of the standard level of said electron gun; a second substep of seeking the center of said reference hole in terms of a coordinate from the thus obtained image thereof; and a third substep of seeking a distance between the thus obtained center of said reference hole and the standard level of said tube previously stored in terms of coordinates.

* * * * *